US009688946B2

(12) United States Patent
Saraf et al.

(10) Patent No.: US 9,688,946 B2
(45) Date of Patent: Jun. 27, 2017

(54) CLEANING COMPOSITION AND METHOD FOR USING THE SAME

(71) Applicant: MILLIKEN & COMPANY, Spartanburg, SC (US)

(72) Inventors: Yogesh Saraf, Pune (IN); Eduardo Torres, Boiling Springs, SC (US); Sanjeev K. Dey, Spartanburg, SC (US); Paul D. Halphen, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 507 days.

(21) Appl. No.: 14/060,918

(22) Filed: Oct. 23, 2013

(65) Prior Publication Data

US 2014/0158166 A1 Jun. 12, 2014

Related U.S. Application Data

(60) Provisional application No. 61/735,214, filed on Dec. 10, 2012.

(51) Int. Cl.

| | |
|---|---|
| ***C11D 3/00*** | (2006.01) |
| ***C11D 3/40*** | (2006.01) |
| ***C11D 11/00*** | (2006.01) |

(52) U.S. Cl.

CPC ..... *C11D 3/0047* (2013.01); *C11D 3/40* (2013.01); *C11D 11/0023* (2013.01)

(58) Field of Classification Search

CPC ..... C11D 3/40; C11D 7/08

See application file for complete search history.

(56) References Cited

U.S. PATENT DOCUMENTS

| | | | | | |
|---|---|---|---|---|---|
| 3,642,423 | A * | 2/1972 | Bil | A61K 8/418 | 564/441 |
| 4,166,804 | A | 9/1979 | Bleha et al. | | |
| 5,049,299 | A * | 9/1991 | Bunczk | C11D 3/485 | 424/672 |
| 5,562,780 | A * | 10/1996 | Bunczk | C11D 3/485 | 134/22.16 |
| 5,773,405 | A * | 6/1998 | Bruhnke | C09B 69/00 | 510/180 |
| 7,628,868 | B2 | 12/2009 | van Buskirk et al. | | |
| 7,745,384 | B2 | 6/2010 | Perry et al. | | |
| 7,977,297 | B2 | 7/2011 | Chaigne et al. | | |
| 8,119,588 | B2 | 2/2012 | Bernhardt et al. | | |
| 8,241,428 | B2 | 8/2012 | Cermenati et al. | | |

FOREIGN PATENT DOCUMENTS

| | | | | |
|---|---|---|---|---|
| DE | 20 2010 005 443 | U1 | 9/2010 | |
| EP | 0 255 978 | A2 | 2/1988 | |
| FR | 2673640 | A1 * | 7/1991 | C11D 3/40 |
| FR | 2 673 640 | A1 | 9/1992 | |
| GB | 1 313 180 | | 4/1973 | |
| GB | 1313180 | A * | 4/1973 | A61K 8/4973 |
| GB | EP 0255978 | A2 * | 2/1988 | C11D 1/40 |
| WO | WO 2012/158733 | A1 | 11/2012 | |

OTHER PUBLICATIONS

Liquitint® Spectrum of Innovation™, www.milliken.com, © 2004 Milliken & Company.

International Search Report for PCT/US2013/066325 (6 pages), Jul. 22, 2014.

Written Opinion of the International Search Authority for PCT/US2013/066325 (9 pages), Jul. 22, 2014.

* cited by examiner

*Primary Examiner* — Gregory Webb

(74) *Attorney, Agent, or Firm* — Robert M. Lanning

(57) ABSTRACT

A cleaning composition comprises at least one surfactant and at least one colorant. The cleaning composition can have a pH of about 3 or less. The colorant exhibits one of several specified structures at a pH of about 7. A method for cleaning a surface utilizes the cleaning composition.

12 Claims, No Drawings

CLEANING COMPOSITION AND METHOD FOR USING THE SAME

CROSS-REFERENCE TO RELATED APPLICATIONS

This application claims, pursuant to 35 U.S.C. §119(e), the benefit of the filing date of U.S. Patent Application No. 61/735,214, which was filed on Dec. 10, 2012.

TECHNICAL FIELD

The subject matter of this application relates to cleaning compositions and methods for using the same. More specifically, the cleaning compositions comprise colorants that undergo a perceptible color change that acts as a visual cue to those using the compositions.

BACKGROUND

Hard surface cleaning compositions, such as compositions adapted for cleaning bath fixtures, are well known in the art. Myriad numbers of adaptations and improvements have been proposed and/or attempted in order to make a compositions which is technically more effective at cleaning the surface to which it is applied. In other words, most of these adaptations and improvements appear to be directed to removing more dirt and grime in a shorter period of time. Relatively few changes appear to be directed to changing or improving the manner in which individuals use and/or interact with the cleaning products. For example, the art does not appear to reflect many attempts to equip users with an easily perceptible indicator that can be used to determine when a sufficient amount of time has elapsed for the cleaning composition to effectively clean the surface. It is believed that such an indicator would be valuable and desirable to users of such compositions.

Accordingly, a need remains for improved cleaning compositions, especially cleaning compositions that provide an easily perceptible indicator for users of the compositions. This application seeks to provide such an improved cleaning composition and a method for using the same to clean a surface.

BRIEF SUMMARY OF THE INVENTION

The subject matter of the application generally relates to cleaning compositions containing colorants having a structure that permits them to undergo a pH-induced color change. The colorants also possess a structure that enables them to be and remain compatible with a variety of cleaning composition formulae over a wide pH range. In use, the pH-induced color change can serve as a visual cue to users.

In a first embodiment, the invention provides a cleaning composition comprising at least one surfactant and at least one colorant, wherein the cleaning composition exhibits a pH of about 3 or less. The colorant is selected from the group consisting of colorants conforming to a structure of Formula (I), (II), (III), or (IV) (defined below) at a pH of about 7.

In a second embodiment, the invention provides a method for cleaning a surface using the disclosed cleaning composition. In particular, the method comprises the steps of: (a) providing the cleaning composition described above, the cleaning composition exhibiting a first color state; (b) applying the cleaning composition to at least a portion of a surface; and (c) raising the pH of at least a portion of the cleaning composition to a sufficient extent that the cleaning composition exhibits a second color state, the second color state being visually distinct from the first color state.

DETAILED DESCRIPTION OF THE INVENTION

In a first embodiment, the invention provides a cleaning composition comprising at least one surfactant and at least one colorant. The surfactant can be any suitable surfactant, but typically the surfactant is a detersive surfactant. Suitable detersive surfactants include, but are not limited to, anionic, nonionic, cationic, amphoteric, and zwitterionic surfactants.

Generally any anionic surfactant material may be used in the cleaning composition as a detersive surfactant. By way of non-limiting example, suitable anionic surfactants include alkali metal salts, ammonium salts, amine salts, or amino-alcohol salts of one or more of the following compounds (linear and secondary): alcohol sulfates and sulfonates; alcohol phosphates and phosphonates; alkyl sulfates; allyl ether sulfates; sulfate esters of an alkylphenoxy polyoxyethylene ethanol; alkyl monoglyceride sulfates; alkyl sulfonates; olefin sulfonates; paraffin sulfonates; beta-alkoxy alkane sulfonates; alkylamidoether sulfates; alkylaryl polyether sulfates; monoglyceride sulfates; alkyl ether sulfonates; ethoxylated alkyl sulfonates; alkylaryl sulfonates; alkyl benzene sulfonates; alkylamide sulfonates; allyl monoglyceride sulfonates; alkyl carboxylates; alkyl sulfoacetates; alkyl ether carboxylates; alkyl alkoxy carboxylates having 1 to 5 moles of ethylene oxide; alkyl sulfosuccinates; alkyl ether sulfosuccinates; alkylamide sulfosuccinates; alkyl sulfosuccinamates; octoxynol or nonoxynol phosphates; alkyl phosphates; alkyl ether phosphates; taurates; N-acyl taurates; fatty taurides; fatty acid amide polyoxyethylene sulfates; isethionates; acyl isethionates; sarcosinates; acyl sarcosinates; or mixtures thereof. Generally, the alkyl or acyl group in these various compounds comprises a carbon chain containing 12 to 20 carbon atoms.

Preferred anionic surfactants include alkyl sulfates which may be represented by the following general formula:

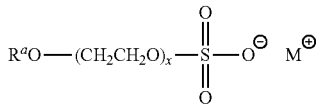

wherein $R^a$ is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Of these, most preferred are the non-ethoxylated $C_{12}$-$C_{15}$ primary and secondary alkyl sulfates.

Exemplary commercially available alkyl sulfates include one or more of those available under the tradenames RHODAPON® (ex. Rhone-Poulenc Co.) as well as STEPANOL® (ex. Stepan Chemical Co.). An exemplary alkyl sulfate which is preferred for use is a sodium lauryl sulfate surfactant presently commercially available as RHODAPON® LCP (ex. Rhone-Poulenc Co.), as well as a further sodium lauryl sulfate surfactant composition which is presently commercially available as STEPANOL® WAC (ex. Stepan Chemical Co.). Exemplary commercially available alkane sulfonate surfactants also include one or more of those available under the tradename HOSTAPUR® (ex. Clariant). An exemplary and particularly alkane sulfonate which is preferred for use is a secondary sodium alkane sulfonate surfactant presently commercially available as HOSTAPUR® SAS from Hoechst Clariant.

Further preferred anionic substituents include allyl sulfonate anionic surfactants which may be represented by the following general formula:

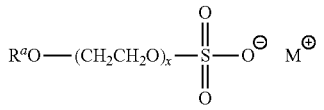

wherein $R^a$ is an straight chain or branched allyl chain having from about 8 to about 18 carbon atoms, and the longest linear portion of the allyl chain is 15 carbon atoms or less on the average, M is a cation which makes the compound water soluble especially an alkali metal such as sodium, or is ammonium or substituted ammonium cation, and x is from 0 to about 4. Most preferred are the $C_{12}$-$C_{15}$ primary and secondary allyl sulfates.

Exemplary useful sarcosinate surfactants include alkali metal salts of N-alkyl-N-acyl amino acids. These are salts derived from the reaction of (1) N-alkyl substituted amino acids of the formula:

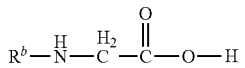

where $R^b$ is a linear or branched chain lower alkyl of from 1 to 4 carbon atoms, especially a methyl, for example, aminoacetic acids such as N-methylaminoacetic acid (i.e. N-methyl glycine or sarcosine), N-ethyl-aminoacetic acid, N-butylaminoacetic acid, etc., with (2) saturated natural or synthetic fatty acids having from 8 to 18 carbon atoms, especially from 10 to 14 carbon atoms, e.g. lauric acid, and the like.

The resultant reaction products are salts which may have the formula:

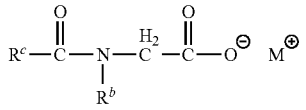

wherein M is an alkali metal ion such as sodium, potassium or lithium; $R^b$ is as defined above; and wherein $R^b$ represents a hydrocarbon chain, preferably a saturated hydrocarbon chain, having from 7 to 17 carbon atoms, especially 9 to 13 carbon atoms of the fatty acyl group

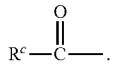

Exemplary useful and preferred sarcosinate surfactants include cocoyl sarcosinate, lauroyl sarcosinate, myristoyl sarcosinate, palmitoyl sarcosinate, stearoyl sarcosinate and oleoyl sarcosinate, and tallow sarcosinate. Such materials are also referred to as N-acyl sarcosinates.

Generally any nonionic surfactant material may be used in the cleaning composition. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. By way of non-limiting example, particularly examples of suitable nonionic surfactants which may be used in the present invention include those described below.

One class of useful nonionic surfactants includes polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature as a $C_8$-$C_{10}$ having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol® ON 110). Other examples of ethoxylated alcohols include the Neodol® 91 series nonionic surfactants available from Shell Chemical Company which are described as $C_9$-$C_{11}$ ethoxylated alcohols. The Neodol® 91 series nonionic surfactants of interest include Neodol® 91-2.5, Neodol® 91-6, and Neodol® 91-8. Neodol® 91-2.5 has been described as having about 2.5 ethoxy groups per molecule; Neodol® 91-6 has been described as having about 6 ethoxy groups per molecule; and Neodol® 91-8 has been described as having about 8 ethoxy groups per molecule. Further examples of ethoxylated alcohols include the Rhodasurf® DA series nonionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mole of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_1$-oxo-alcohol polyglycol ether with 11 EO.

A further class of useful nonionic surfactants include those surfactants having a formula $R^dO(CH_2CH_2O)_nH$ wherein $R^d$ is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3,24-L-45, 24-L-50, 24-L-60, 24-L-60N, 24-L-75, 24-L-92, and 24-L-98N, all sold under the Genapol® tradename.

A further class of useful nonionic surfactants include alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula:

$$HO\text{-}(EO)_x(PO)_y(EO)z\text{-}H$$

where EO represents ethylene oxide, PO represents propylene oxide, y equals at least 15, the amount of (EO) equals 20 to 50% of the total weight of said compounds, and, the total molecular weight is preferably in the range of about 2000 to 15,000. These surfactants are available under the PLURONIC® (ex. BASF) or Emulgen® (ex. Kao.) A further group of such useful nonionic surfactants containing the characteristic alkylene oxide blocks are those can be represented by the formula:

$$R^eO\text{-}(EO,PO)_a(EO,PO)_b\text{—}H$$

wherein $R^e$ is an alkyl, aryl or aralkyl group, the $R^e$ group contains 1 to 20 carbon atoms, the weight percent of EO is within the range of 0 to 45% in one of the blocks a and b and within the range of 60 to 100% in the other of the blocks a and b, and the total number of moles of combined EO and PO is in the range of 6 to 125 moles, with 1 to 50 moles in the PO rich block and 5 to 100 moles in the EO rich block. Specific nonionic surfactants which in general are encompassed by the above formula include butoxy derivatives of propylene oxide/ethylene oxide block polymers having molecular weights within the range of about 2,000-5,000.

Still further examples of useful nonionic surfactants include those which can be represented by the formula:

$$R^fO\text{—}(BO)_n(EO)_x\text{—}H$$

wherein EO represents ethylene oxide, BO represents butylene oxide, $R^f$ is an alkyl group containing 1 to 20 carbon atoms, n is about 5-15 and x is about 5-15.

Yet further useful nonionic surfactants include those which may be represented by the following formula:

$$HO\text{-}(EO)_x(BO)_n(EO)_y\text{—}H$$

wherein EO represents ethylene oxide, BO represents butylene oxide, n is about 5-15, preferably about 15, x is about 5-15, preferably about 15, and y is about 5-15, preferably about 15.

Still further examples of useful nonionic block copolymer surfactants include ethoxylated derivatives of propoxylated ethylene diamine, which may be represented by the following formula:

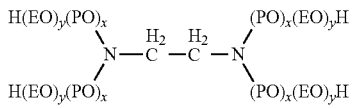

where (EO) represents ethylene oxide, (PO) represents propylene oxide, the amount of $(PO)_x$ is such as to provide a molecular weight prior to ethoxylation of about 300 to 7,500, and the amount of $(EO)_y$ is such as to provide about 20% to 90% of the total weight of said compound.

Further useful nonionic surfactants which may be used in the cleaning composition include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is on the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Alkylmonoglyocosides and alkylpolyglycosides which find use in the present cleaning composition include known nonionic surfactants which are alkaline and electrolyte stable. Alkylmonoglycosides and alkylpolyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for malting them are disclosed in U.S. Pat. Nos. 2,974,134; 3,219,656; 3,598,865; 3,640,998; 3,707,535, 3,772,269; 3,839,318; 3,974,138; 4,223,129 and 4,528,106 the contents of which are incorporated by reference.

One exemplary group of such useful alkylpolyglycosides include those according to the formula:

$$R^gO—(C_nH_{2-n}O)_r—(Z^a)_x$$

wherein: $R^g$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3; r is an integer from 0 to 10, but is preferably 0, $Z^a$ is derived from glucose; and, x is a value from about 1 to 8, preferably from about 1.5 to 5. Preferably the alkylpolyglycosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

A further exemplary group of allyl glycoside surfactants suitable for use in the cleaning composition may be presented by the following formula:

$$R^hO—(R^iO)_y-(G)_x-Z^b$$

wherein $R^h$ is a monovalent organic radical containing from about 6 to about 30, preferably from about 8 to 18 carbon atoms, $R^i$ is a divalent hydrocarbon radical containing from about 2 to about 4 carbon atoms, y is a number which has an average value from about 0 to about 1 and is preferably 0, G is a moiety derived from reducing a saccharide containing 5 or 6 carbon atoms; and, x is a number having an average value from about 1 to 5 (preferably from 1.1 to 2); $Z^b$ is $O_2M^1$, $$—O—\overset{O}{\overset{\|}{C}}—R^j,$$

$O(CH_2)$, $CO_2M^1$, $OSO_3M^1$, or $O(CH_2)SO_3M^1$; $R^j$ is $(CH_2)CO_2M^1$ or $CH{=}CHCO_2M^1$; (with the proviso that $Z^b$ can be $O_2M^1$ only if $Z^b$ is in place of a primary hydroxyl group in which the primary hydroxyl-bearing carbon atom, $—CH_2OH$, is oxidized to form a $$—\overset{O}{\overset{\|}{C}}—OM^1$$

group) b is a number of from 0 to 3x+1 preferably an average of from 0.5 to 2 per glycosal group; p is 1 to 10, $M^1$ is $H^+$ or an organic or inorganic counterion, particularly cations such as, for example, an alkali metal cation, ammonium cation, monoethanolamine cation or calcium cation. As defined in the formula above, $R^j$ is generally the residue of a fatty alcohol having from about 8 to 30 and preferably 8 to 18 carbon atoms. Examples of such alkylglycosides as described above include, for example, APG 325 CS Glycoside® which is described as being a 50% $C_9$-$C_{11}$ alkyl polyglycoside, also commonly referred to as D-glucopyranoside, (commercially available from Henkel KGaA) and Glucopon® 625 CS which is described as being a 50% $C_{10}$-$C_{16}$ alkyl polyglycoside, also commonly referred to as a D-glucopyranoside, (ex. Henkel).

Still further useful nonionic surfactants include those based on tallowamine, such as PEG-2 tallowamines.

Further nonionic surfactants which may be included in the cleaning composition include alkoxylated alkanolamides, preferably $C_8$-$C_{24}$ alkyl di($C_2$-$C_3$ alkanol amides), as represented by the following formula:

$$R^k—\overset{O}{\overset{\|}{C}}—\overset{H}{N}—R^m—OH$$

wherein $R^k$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R^m$ is a $C_1$-$C_4$ alkyl radical, preferably an ethyl radical.

The cleaning composition may also include a nonionic amine oxide constituent. Exemplary amine oxides include:

(A) Alkyl di(lower alkyl)amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

(B) Alkyl di(hydroxy lower alkyl)amine oxides in which the alkyl group has about 10-20, and preferably 12-16 carbon atoms, and can be straight or branched chain, saturated or unsaturated. Examples are bis(2-hydroxyethyl)cocoamine oxide, bis(2-hydroxyethyl)tallowamine oxide; and bis(2-hydroxyethyl)stearylamine oxide;

(C) Alkylamidopropyl di(lower alkyl)amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and (D) Alkylmorpholine oxides in which the alkyl group has about 10-20, and preferably 12-16 carbon atoms, and can be straight or branched chain, saturated or unsaturated.

Preferably the amine oxide constituent is an alkyl di(lower alkyl)amine oxide as denoted above and which may be represented by the following structure:

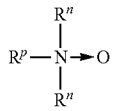

wherein each $R^n$ is a straight chained $C_1$-$C_4$ allyl group, preferably both $R^n$ are methyl groups; and, $R^p$ is a straight chained $C_8$-$C_{18}$ alkyl group, preferably is $C_{10}$-$C_{14}$ alkyl group, most preferably is a $C_{12}$ alkyl group. Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R^p$ group are present. Preferably, the amine oxides used in the present invention include $R^p$ groups which comprise at least 50 wt. %, preferably at least 60 wt. % of $C_{12}$ alkyl groups and at least 25 wt. % of $C_{14}$ alkyl groups, with not more than 15 wt. % of $C_{16}$, $C_{18}$ or higher alkyl groups as the $R^p$ group.

Of course the nonionic surfactant constituent, when present, may comprise two or more nonionic surfactants. In certain preferred embodiments the cleaning composition comprises at least one nonionic surfactant. When present, any nonionic surfactants present in the compositions of the present invention are desirably included in an amount of from about 0.01 wt. % to about 20 wt. %, more preferably is present in an amount of from about 0.1-20 wt. %, and most preferably is present in an amount of from about 1 to about 10 wt. %

The compositions according to the invention may optionally further comprise an alkyl ethoxylated carboxylate surfactant. In particular, the alkyl ethoxylated carboxylate comprises compounds and mixtures of compounds which may be represented by the formula:

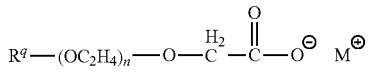

wherein $R^q$ is a $C_4$-$C_{18}$ alkyl, n is from about 3 to about 20, and M is hydrogen, a solubilizing metal, preferably an alkali metal such as sodium or potassium, or ammonium or lower alkanolammonium, such as triethanolammonium, monoethanolammonium, or diisopropanolammonium. The lower alkanol of such alkanolammonium will normally be of 2 to 4 carbon atoms and is preferably ethanol. Preferably, $R^q$ is a $C_{12}$-$C_{15}$ alkyl, n is from about 7 to about 13, and M is an alkali metal counterion.

Examples of alkyl ethoxylated carboxylates contemplated to be useful in the present invention include, but are not necessarily limited to, sodium buteth-3 carboxylate, sodium hexeth-4 carboxylate, sodium laureth-5 carboxylate, sodium laureth-6 carboxylate, sodium laureth-8 carboxylate, sodium laureth-11 carboxylate, sodium laureth-13 carboxylate, sodium trideceth-3 carboxylate, sodium trideceth-6 carboxylate, sodium trideceth-7 carboxylate, sodium trideceth-19 carboxylate, sodium capryleth-4 carboxylate, sodium capryleth-6 carboxylate, sodium capryleth-9 carboxylate, sodium capryleth-13 carboxylate, sodium ceteth-13 carboxylate, sodium $C_{12-15}$ pareth-6 carboxylate, sodium $C_{12-15}$ pareth-7 carboxylate, sodium $C_{14-15}$ pareth-8 carboxylate, isosteareth-6 carboxylate as well as the acid form. Sodium-laureth-8 carboxylate, sodium laureth-13 carboxylate, pareth-25-7 carboxylic acid are preferred. A particularly preferred sodium laureth-13 carboxylate can be obtained from Clariant Corp. under the trade name Sandopan® LS-24.

When present, any alkyl ethoxylated carboxylate surfactant present in the cleaning composition of the present invention is desirably included in an amount of from about 0.1 to about 20% by weight, more preferably in an amount of from about 0.1-20 wt. %, and most preferably in an amount of from about 1 to about 10 wt. %

By way of non-limiting example, amphoteric surfactants suitable for use in the cleaning composition include one or more water-soluble betaine surfactants which may be represented by the general formula:

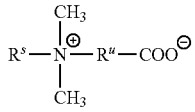

wherein $R^s$ is an alkyl group containing from 8 to 18 carbon atoms, or the amido radical which may be represented by the following general formula:

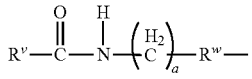

wherein $R^v$ is an alkyl group having from 8 to 18 carbon atoms, a is an integer having a value of from 1 to 4 inclusive, and $R^w$ is a $C_1$-$C_4$ alkylene group. Examples of such water-soluble betaine surfactants include dodecyl dimethyl betaine, as well as cocoamidopropylbetaine.

The cleaning composition may comprise a detersive surfactant based on a cationic surfactant compound. Certain of these cationic surfactant compounds may also provide a disinfecting or sanitizing benefit to the compositions of which they form a part. Other cationic surfactant compounds may provide a thickening benefit to the compositions of which they form a part.

Exemplary cationic surfactant compounds which may also provide a disinfecting or sanitizing benefit to the compositions include cationic surfactant compositions which provide a germicidal effect to the compositions, and especially preferred are quaternary ammonium compounds and salts thereof, which may be characterized by the general formula:

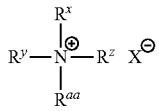

where at least one of $R^x$, $R^y$, $R^z$ and $R^{aa}$ is an alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxy-alkyl, arylalkyl, etc. The remaining substituents on the nitrogen atoms other than the abovementioned alkyl substituents are hydrocarbons usually containing no more than 12 carbon atoms. The substituents $R^x$, $R^y$, $R^z$ and $R^{aa}$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

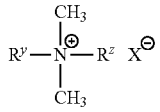

wherein $R^y$ and $R^z$ are the same or different $C_8$-$C_{12}$ alkyl, or $R^y$ is $C_{12-16}$ alkyl, $C_{8-18}$ alkylethoxy, $C_{8-18}$ alkylphenolethoxy and $R^z$ is benzyl, and X is a halide, for example chloride, bromide or iodide, or is a methosulfate anion. The alkyl groups recited in $R^y$ and $R^z$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks.

Cationic surfactant compounds which may be used in the compositions of the invention and which may provide a thickening benefit to the compositions include alkoxylated fatty amine compounds. Such alkoxylated fatty amine compounds include primary, secondary and tertiary fatty amines. Exemplary primary fatty amine compounds include for example, those which may be represented by the following structural representation: R—$NH_2$ wherein R is based on a technical grade mixture of predominantly $C_{10}$-$C_{20}$ straight chained or branched alkyl groups, but preferably are predominantly $C_{16}$-$C_{18}$ straight chained or branched alkyl groups, which groups may be saturated or unsaturated.

Exemplary primary fatty amine compounds include for example, those which may be represented by the following structural representation:

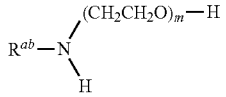

wherein $R^{ab}$ is based on a technical grade mixture of predominantly $C_{10}$-$C_{20}$ straight chained or branched alkyl groups, but preferably are predominantly $C_{16}$-$C_{18}$ straight chained or branched alkyl groups, which groups may be saturated or unsaturated; and, m has a value of from about 2 to about 10, inclusive.

Exemplary alkoxylated fatty tertiary amines include those which may be represented by the following formula:

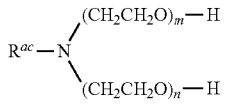

wherein $R^{ac}$ is based on a technical grade mixture of predominantly $C_{10}$-$C_{20}$ straight chained or branched alkyl groups, but preferably are predominantly $C_{16}$-$C_{18}$ straight chained or branched alkyl groups, which groups may be saturated or unsaturated; and wherein m+n=2-10, but preferably m+n=4-6.

It is to be understood that other alkoxylated fatty amines which are not represented by any of the structures indicated above may also be used in the cleaning composition, and that these structures provide examples by way of illustration but not by way of limitation. These materials are available from a variety of sources and include for example alkoxylated amines presently commercially available in the DeThox® Amine series (DeForest Enterprises, Inc.) including DeThox® Amine C-5 and DeThox® Amine C-15, both which are described to be cocoamine ethoxylates, in the Hetoxamine® series (Heterine Inc.) including Hetoxamine® T-5 described to be a PEG-5 tallowamine, Hetoxamine® T-15 described to be a POE-15 tallowamine, and Hetoxamine® described to be a POE-20 tallowamine, as well as in the Rhodameen® series (Rhone-Poulenc) but further useful alkoxylated amines may also be obtained from other commercial sources. One such further class of alkoxylated amines are PEG-tallowamines which include various grades of polyethylene glycol (PEG) polymer which are commercially available under the Aminogen® tradename. Particularly useful and most preferred are the fatty amine compounds disclosed below. These alkoxylated fatty amine surfactants may be used singly, or in combination with one another to form mixtures.

The foregoing discussion and listing of surfactants is intended to be illustrative of the detersive surfactants that are suitable for use in the cleaning composition. It is not intended to be limiting or imply that only the listed surfactants or doses of surfactants are suitable for use in the cleaning composition. Indeed, it is believed that any detersive surfactant known to be suitable for use in similar cleaning compositions (e.g., acidic cleaning compositions) will also be suitable for use in the instant cleaning composition. However, preferred surfactants desirable for preferred embodiments of the cleaning composition are identified above.

The composition of the invention comprises at least one surfactant (e.g., a detersive surfactant). Preferably, the at least one surfactant (e.g., detersive surfactant) is present in the composition in an amount of about 0.01 wt. % or more, about 0.05 wt. % or more, about 0.1 wt. % or more, about 0.5 wt. % or more, or about 0.75 wt. % or more. Preferably, the total amount of surfactant(s) present in the cleaning composition is about 20 wt. % or less, about 15 wt. % or less, about 10 wt. % or less, about 7.5 wt. % or less, or about 5 wt. % or less. Thus in a series of preferred embodiments, the total amount of surfactant (e.g., detersive surfactant) present in the cleaning composition is about 0.5 to about 20 wt. %, about 0.05 to about 7.5 wt. %, more preferably about 0.75 to 5 wt. %.

The cleaning composition of the invention preferably comprises at least one colorant. Preferably, the colorant possesses a structure such that the colorant exhibits a first color state at the relatively low pH of the cleaning composition (e.g., a pH of about 4 or less, about 3 or less, or about 2 or less) and exhibits a second color state at a higher pH (e.g., a pH of about 6 or more, or about 7 or more). The first color state and the second color state are visually distinct, meaning that an individual can visually perceive a difference between the two color states. As utilized herein in reference to the colorant and the cleaning composition, the term "color state" (e.g., first color state and second color state) refers to the particular color characteristics exhibited by the colorant or composition at a given set of conditions. A color state can be a particular color selected from the range of visually perceptible colors (e.g., red, orange, yellow, green, blue, violet, white, black, and shades there between) or a color state can be the absence of a visually perceptible color (i.e., the colorant or the composition is colorless). As noted above, the first color state (i.e., the color state exhibited at the low pH) and the second color state (i.e., the color state exhibited at the higher pH) are visually distinct. This perceptible change in the color state permits a user of the cleaning composition to visually confirm the action of the cleaning composition, which is usually accompanied by a rise in pH as the cleaning composition interacts with dirt, grime, etc. on the surface to be cleaned and/or is diluted with water added during the cleaning process.

The colorant included in the cleaning composition can be any suitable colorant exhibiting the color change behavior described above. Suitable classes of colorants include, but are not limited to, triarylmethane colorants, azo colorants (e.g., monoazo colorants, diazo colorants, and azothiophene colorants), anthraquinone colorants, and phthalocyanine colorants. As noted elsewhere herein, the cleaning composition of the invention typically is aqueous or comprises a relatively large amount of water in combination with a surfactant. Given this fact, the colorant preferably is dispersible in or miscible with the water and surfactant mixture so that a stable cleaning composition can be formed.

In a preferred embodiment, the cleaning composition comprises a colorant conforming to the structure of Formula (I) at a pH of about 7

(I)

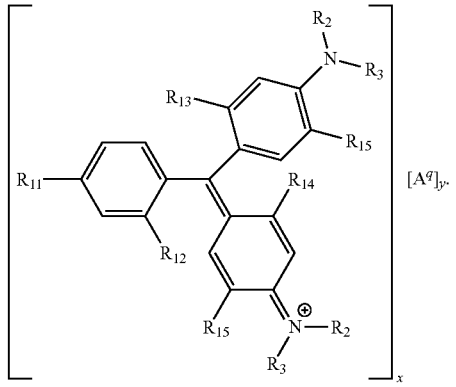

In the structure of Formula (I), $R_{11}$ is selected from the group consisting of hydrogen, alkylamino, $—SO_3^-$, and $—CO_2^-$; $R_{12}$ is selected from the group consisting of hydrogen, $—SO_3^-$, and $—CO_2^-$; $R_{13}$ and $R_{14}$ are independently selected from the group consisting of hydrogen and $C_1$-$C_4$ alkyl; and $R_{15}$ is selected from the group consisting of hydrogen and alkanediyl groups bonded to the nitrogen atom through $R_3$ to form a six membered ring. A is an anion; q is the charge of the anion A; x is a positive integer, and y is zero or a positive integer. The variable y is zero when one of $R_{11}$ and $R_{12}$ is selected from the group consisting of $—SO_3^-$ and $—CO_2^-$; y is a positive integer when neither $R_{11}$ nor $R_{12}$ is selected from the group consisting of $—SO_3^-$ and $—CO_2^-$. When the variable y is a positive integer, the values of x, q, and y satisfy the equation $x=-1q\cdot y$.

In a preferred embodiment, the cleaning composition comprises a colorant conforming to the structure of Formula (II) at a pH of about 7

(II)

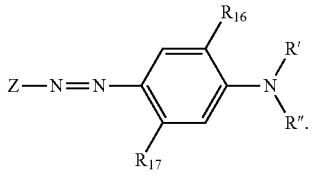

In the structure of Formula (II), R' is selected from the group consisting of hydrogen and $R_2$; R" is selected from the group consisting of hydrogen and $R_3$; $R_{16}$ is selected from the group consisting of hydrogen, hydroxyl, $C_1$-$C_4$ alkyl, $C_1$-$C_4$ alkoxy, and $—SO_3^-D$; and $R_{17}$ is selected from the group consisting of hydrogen, hydroxyl, $C_1$-$C_4$ alkyl, and $C_1$-$C_4$ alkoxy. Z is selected from the group consisting of substituents conforming to a structure of Formula (IIA), (IIB), (IIC), or (IID) as defined below.

The structure of Formula (IIA) is (IIA)

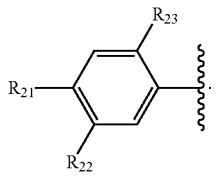

In the structure of Formula (IIA), $R_{21}$ is selected from the group consisting of hydrogen, $—CO_2^-M$, and $—SO_3^-D$; and $R_{22}$ and $R_{23}$ are independently selected from the group consisting of hydrogen and $—SO_3^-M$.

The structure of Formula (IIB) is (IIB)

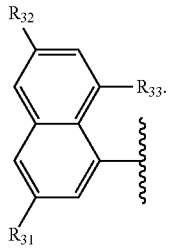

In the structure of Formula (IIB), $R_{31}$ and $R_{32}$ are independently selected from the group consisting of hydrogen and $—SO_3^-M$; and $R_{33}$ is selected from the group consisting of hydrogen and hydroxyl.

The structure of Formula (IIC) is (IIC)

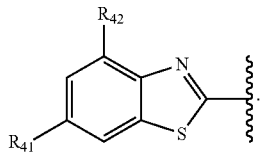

In the structure of Formula (IIC), $R_{41}$ and $R_{42}$ are independently selected from the group consisting of hydrogen, $C_1$-$C_4$ alkyl, alkoxy (e.g., $C_1$-$C_8$ alkoxy or $C_1$-$C_4$ alkoxy), $—SO_3^-M$, $—CO_2^-M$, and $—NO_2$.

The structure of Formula (IID) is (IID)

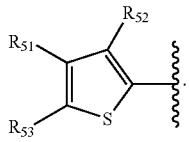

In the structure of Formula (IID), $R_{51}$ is selected from the group consisting of hydrogen and $C_1$-$C_4$ alkyl, and $R_{52}$ and $R_{53}$ are independently selected from the group consisting of hydrogen, alkyl, alkyl ester, cyano, aryl, amide, nitro, alkanoyl, aryloyl, a sulfonic acid group, and halogen.

In the structures of Formula (IIA)-(IID), each M is independently selected from the group consisting of metal cations (e.g., alkali metal cations or alkaline earth metal cations); and each D is independently selected from the group consisting of M and a quaternary ammonium group conforming to the structure of Formula (X)

(X)

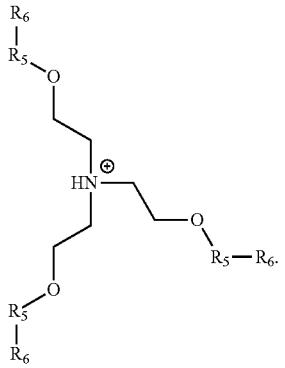

If R' and R" of the structure of Formula (II) are both hydrogen, then Z is a substituent conforming to the structure of Formula (IIA) and at least one of $R_{16}$ and $R_{21}$ is $—SO_3^-D$ in which D is a quaternary ammonium group conforming to the structure of Formula (X).

In a more specific and preferred embodiment, the cleaning composition comprises a colorant conforming to the structure of Formula (V)

(V)

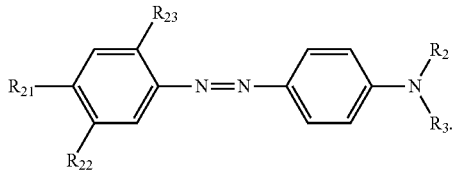

In the structure of Formula (V), $R_{21}$ is selected from the group consisting of hydrogen and $—CO_2^-Na^+$; and $R_{22}$ and $R_{23}$ are independently selected from the group consisting of hydrogen and $—SO_3^-Na^+$.

In another specific preferred embodiment, the cleaning composition comprises a colorant conforming to the structure of Formula (VI)

(VI)

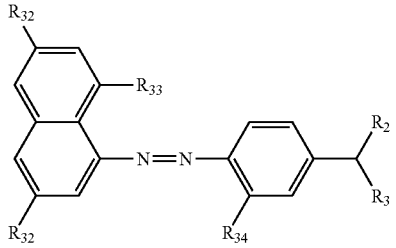

In the structure of Formula (VI), $R_{31}$ and $R_{32}$ are independently selected from the group consisting of hydrogen and $—SO_3^-Na^+$; $R_{33}$ is selected from the group consisting of hydrogen and hydroxyl; and $R_{34}$ is selected from the group consisting of hydrogen and $C_1$-$C_4$ alkyl.

In another specific preferred embodiment, the cleaning composition comprises a colorant conforming to the structure of Formula (VII)

(VII)

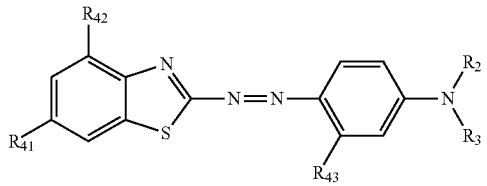

In the structure of Formula (VII), $R_{41}$ and $R_{42}$ are independently selected from the group consisting of hydrogen, $C_1$-$C_4$ alkyl, alkoxy (e.g., $C_1$-$C_8$ alkoxy or $C_1$-$C_4$ alkoxy), —$SO_3^-M$, —$CO_2^-M$, and —$NO_2$.

In another specific preferred embodiment, the cleaning composition comprises a colorant conforming to the structure of Formula (VIII)

(VIII)

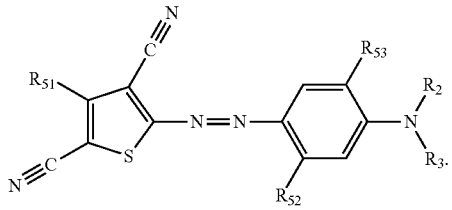

In the structure of Formula (VIII), $R_{51}$ is selected from the group consisting of hydrogen and $C_1$-$C_4$ alkyl; and $R_{52}$ and $R_{53}$ are independently selected from the group consisting of hydrogen and $C_1$-$C_4$ alkoxy.

In another specific preferred embodiment, the colorant conforms to the structure of Formula (IX)

(IX)

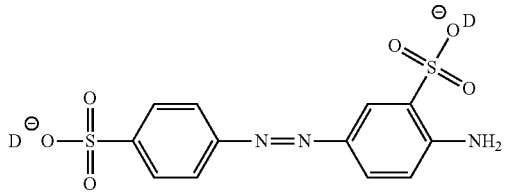

In the structure of Formula (IX), at least one D is a quaternary ammonium group conforming to the structure of Formula (X).

In a preferred embodiment, the cleaning composition comprises a colorant conforming to the structure of Formula (III) at a pH of about 7

(III)

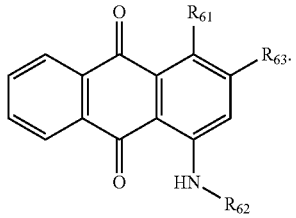

In the structure of Formula (III), $R_{61}$ is selected from the group consisting of hydrogen, hydroxyl, and —$NHR_{64}$; $R_{64}$ is selected from the group consisting of hydrogen, $R_2$, and E; and $R_{62}$ is selected from the group consisting of aryl groups, $R_3$, and G. $R_{63}$ is selected from the group consisting of hydrogen and —O—$R_5$—$R_6$, provided that $R_{63}$ is —O—$R_5$—$R_6$ when $R_{61}$ is hydrogen or when $R_{61}$ is —$NHR_{64}$, $R_{64}$ is hydrogen, and $R_{62}$ is an aryl group. In the structure of Formula (III), E is a group conforming to the structure of Formula (XI)

(XI)

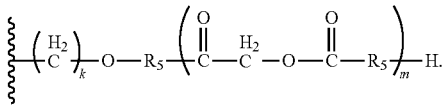

In the structure of Formula (XI), k is an integer from 1 to 10; m is an integer from 0 to 10. In the structure of Formula (III), G is a group conforming to the structure of Formula (XII)

(XII)

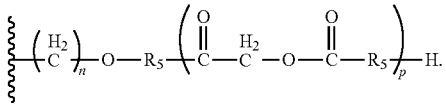

In the structure of Formula (XII), n is an integer from 1 to 10; and p is an integer from 0 to 10. When $R_{61}$ is —$NHR_{64}$, $R_{64}$ is E, and $R_{62}$ is G, the sum of m and p is from 1 to 10.

In a preferred embodiment, the cleaning composition comprises a colorant conforming to the structure of Formula (IV) at a pH of about 7

(IV)

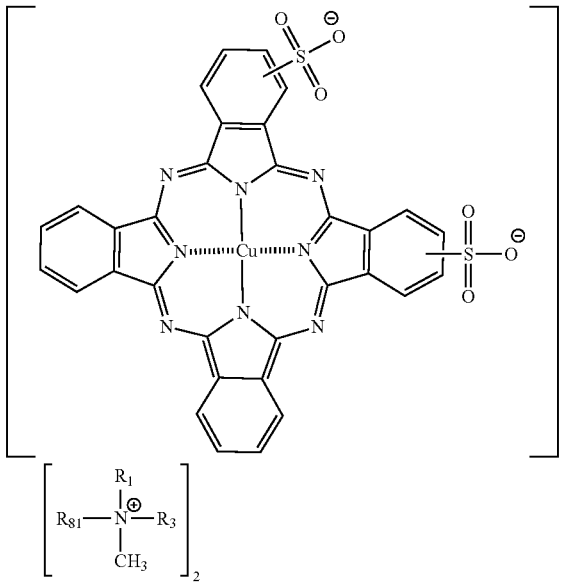

In the structure of Formula (IV), $R_{81}$ is selected from the group consisting of $C_8$-$C_{20}$ alkanoyl or alkenoyl groups.

In each of the structures of Formula (I)-(XII) and their associated substructures, $R_2$ is selected from the group consisting of —$R_4$—O—$R_5$—$R_6$; and $R_3$ is selected from the group consisting of —$R_4$—O—$R_5$—$R_6$ and a bond to $R_{15}$ when $R_{15}$ is an alkanediyl group. $R_4$ is selected from the group consisting of alkanediyl groups and arenediyl groups; and $R_6$ is selected from the group consisting of hydrogen, alkyl groups, alkanoyl groups, alkenoyl groups, and aryloyl groups. $R_5$ is a divalent substituent selected from the group consisting of:

(i) divalent substituents comprising two or more divalent repeating units independently selected from repeating units conforming to the structure of Formula (XX)

(XX)

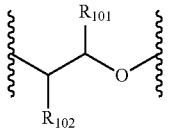

wherein $R_{101}$ and $R_{102}$ are independently selected from the group consisting of hydrogen, alkyl (e.g., $C_1$-$C_8$ alkyl, $C_1$-$C_4$ alkyl, or $C_1$-$C_2$ alkyl), hydroxyalkyl, aryl, alkoxyalkyl, and aryloxyalkyl;

(ii) divalent substituents conforming to the structure of Formula (XXI)

(XXI)

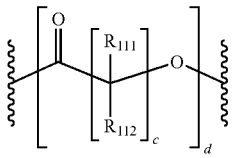

wherein $R_{111}$ and $R_{112}$ are independently selected from the group consisting of hydrogen, hydroxyl, and $C_1$-$C_{10}$ alkyl, c is an integer from 1 to 12, and d is a positive integer (e.g., an integer from 1 to 100);

(iii) divalent substituents conforming to the structure of Formula (XXII)

(XXII)

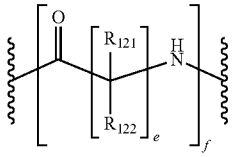

wherein $R_{121}$ and $R_{122}$ are independently selected from the group consisting of hydrogen, hydroxyl, and $C_1$-$C_{10}$ alkyl, e is an integer from 1 to 12, and f is a positive integer (e.g., an integer from 1 to 100);

(iv) divalent substituents conforming to the structure of Formula (XXIII)

(XXIII)

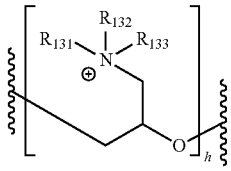

wherein $R_{131}$, $R_{132}$, and $R_{133}$ are independently selected from alkyl and hydroxyalkyl, and h is a positive integer (e.g., an integer from 1 to 100); and (v) divalent substituents comprising two or more substituents selected from the group consisting of substituents conforming to a structure of Formula (XX), (XXI), (XXII), or (XXIII).

In a series of particularly preferred embodiments of the colorants, $R_5$ is a divalent substituent conforming to a structure of Formula (XXA), (XXB), or (XXC)

(XXA)

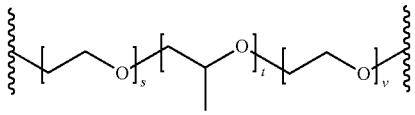

(XXB)

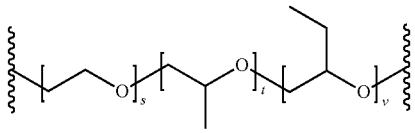

(XXC)

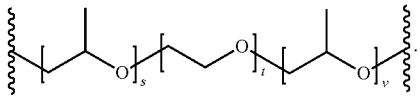

In the structures of Formulae (XXA), (XXB), and (XXC), s, t, and v are selected from the group consisting of zero and positive integers (e.g., integers from 0 to about 100); and the sum of s, t, and v is 2 or more (e.g., 2 to about 300, 2 to about 200, or 2 to about 100).

In the structures of Formulae (XXA), (XXB), and (XXC), the divalent substituent $R_5$ is depicted as comprising a series of repeating units arranged in a block configuration. While such an arrangement of the repeating units is possible and potentially preferred, the repeating units comprising the divalent substituent $R_5$ can also be arranged in a random configuration or in any suitable combination of a block configuration and a random configuration. For example, $R_5$ can be a divalent substituent comprising a series of two or more different repeating units conforming to the structure of Formula (XX) arranged in a random configuration or a divalent substituent comprising a series of two more different repeating units conforming to the structure of Formula (XX) and one or more repeating units conforming to the structure of Formula (XXI) all arranged in a random configuration. Also, $R_5$ can be a divalent substituent comprising a series of two or more different repeating units conforming to the structure of Formula (XX) arranged in a random configuration followed by a block of repeating units conforming to the structure of Formula (XXI).

The cleaning composition of the invention exhibits an acidic pH, preferably a pH of about 4 or less, about 3 or less, about 2.5 or less, or about 2 or less. In order to achieve such a low pH, the cleaning composition typically comprises at least one acid. The cleaning composition can comprise any suitable acid, such as an inorganic acid (e.g., a mineral acid), an organic acid, and combinations or mixtures thereof.

Inorganic acids suitable for use in the cleaning composition include sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid.

Organic acids suitable for use in the cleaning composition include, but are not limited to, any known art organic acid which include at least one carbon atom, and include at least one carboxyl group (—COOH) in its structure. Preferred are water soluble organic acids which contain from 1 to about 6 carbon atoms, and at least one carboxyl group as noted. Specific examples of such organic acids include, but are not limited to, linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids.

Preferred examples of the organic acid to be used in the present invention include linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids. Preferred useful organic acids include citric acid, cresylic acid, dodecylbenzene sulfonic acid, phosphoric acid, salicylic acid, sorbic acid, sulfamic acid, acetic acid, benzoic acid, boric acid, capric acid, caproic acid, cyanuric acid, dihydroacetic acid, dimethylsulfamic acid, polyacrylic acid, 2-ethyl-hexanoic acid, fumaric acid, l-glutamic acid, isopropyl sulfamic acid, naphthenic acid, oxalic acid, phosphorous acid, valeric acid, benzene sulfonic acid, xylene sulfonic acid, sulfonic acids, maleic acid, acetic acid, adipic acid, formic acid, lactic acid, butyric acid, gluconic acid, malic acid, tartaric acid, as well as glycolic acid.

These acids can be used singly or as a mixture of two or more. While they may be present in any effective amount in order to attain a desired acidic pH, advantageously they are present in an amount of from about 0.001-15 wt. %, and more preferably from 0.001-10 wt. % based on the total weight of the compositions of which they form a part.

The cleaning composition can comprise any suitable solvent or medium to which the surfactant(s) and colorant(s) have been added. Typically, the cleaning composition comprises an aqueous medium. The water used to provide this aqueous medium can be municipal water or filtered water, but typically deionized water or distilled water is preferred. The cleaning composition can comprise any suitable amount of water. Preferably, the cleaning composition comprises about 50 wt. % or more, about 55 wt. % or more, about 60 wt. % or more, about 65 wt. % or more, about 70 wt. % or more, about 75 wt. % or more, or about 80 wt. % or more water. The cleaning composition preferably comprises about 99 wt. % or less, or about 98 wt. % or less water.

The compositions of the invention may also include one or more further optional constituents which may be included in order to provide a technical or aesthetic benefit to the compositions. By way of non-limiting example, such constituents include: thickeners, organic solvents, bleach or oxidizing agents, coloring agents, including dyes and pigment compositions, fragrances (whether natural or synthetically produced), fragrance adjuvants and/or fragrance solubilizers, pH-adjusting agents, pH buffers, salts including inorganic or organic salts which may provide electrolytes to the compositions, film forming constituents, preservative compositions, as well as other known art additives not particularly listed here. Such constituents as described above include known art compositions, including those described in McCutcheon's Detergents and Emulsifiers, North American Edition, 1998; Kirk-Othmer Encyclopedia of Chemical Technology, 4th Ed., Vol. 23, pp. 478-541, the contents of which are herein incorporated by reference.

The compositions of the invention can comprise a thickening constituent or constituents which form a thickener system. Thickeners useful in the present invention to achieve the desired viscosity are selected from the group consisting of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy allyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

Examples of the cellulose derivatives include methyl cellulose ethyl cellulose, hydroxymethyl cellulose hydroxy ethyl cellulose, hydroxy propyl cellulose, carboxy methyl cellulose, carboxy methyl hydroxyethyl cellulose, hydroxypropyl cellulose, hydroxy propyl methyl cellulose, ethylhydroxymethyl cellulose and ethyl hydroxy ethyl cellulose.

Exemplary polycarboxylate polymers thickeners have a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

The polycarboxylate polymer can be a non-associative thickener or stabilizer, such as a homopolymer or a copolymer of an olefinically unsaturated carboxylic acid or anhydride monomers containing at least one activated carbon to carbon olefinic double bond and at least one carboxyl group or an alkali soluble acrylic emulsion, or an associative thickener or stabilizer, such as a hydrophobically modified alkali soluble acrylic emulsion or a hydrophobically modified nonionic polyol polymer, i.e., a hydrophobically modified urethane polymer, or combinations thereof. The copolymers are preferably of a polycarboxylic acid monomer and a hydrophobic monomer. The preferred carboxylic acid is acrylic acid. The homopolymers and copolymers preferably are crosslinked.

Homopolymers of polyacrylic acid are homopolymers of unsaturated, polymerizable carboxylic monomers such as acrylic acid, methacrylic acid, maleic acid, itaconic acid, maleic anhydride, and the like.

Hydrophobically modified polyacrylic acid polymers are polymers have a large hydrophilic portion (the polyacrylic acid portion) and a smaller hydrophobic portion (which can be derived from a long carbon chain acrylate ester). Representative higher alkyl acrylic esters are decycl acrylate, lauryl acrylate, stearyl acrylate, behenyl acrylate and melissyl acrylate, and the corresponding methacrylates. It should be understood that more than one carboxylic monomer and more than one acrylate ester or vinyl ester or ether or styrenic can be used in the monomer charge. The polymers can be dispersed in water and neutralized with base to thicken the aqueous composition, form a gel, or emulsify or suspend a deliverable. Exemplary hydrophobically modified polyacrylic polymers are sold as Carbopol® 1342 and 1382 and Pemulen® TR-1, TR-2, 1621, and 1622. The carboxyl containing polymers are prepared from monomers containing at least one activated vinyl group and a carboxyl group, and would include copolymers of polymerizable carboxylic monomers with acrylate esters, acrylamides, alkylated acrylamides, olefins, vinyl esters, vinyl ethers, or styrenics. The carboxyl containing polymers have molecular weights greater than about 500 to as high as several billion, or more, usually greater than about 10,000 to 900,000 or more.

Also useful are interpolymers of hydrophobically modified monomers and steric stabilizing polymeric surface active agents having at least one hydrophilic moiety and at least one hydrophobic moiety or a linear block or random comb configuration or mixtures thereof. Examples of steric stabilizers which can be used are Hypermer®, which is a poly(12-hydroxystearic acid) polymer, (ex. ICI) and Pecosil®, which is a methyl-3-polyethoxypropyl siloxane-.omega.-phosphate polymer, (ex. Phoenix Chemical, Somerville, N.J.)

The polymers can be crosslinked in a manner known in the art by including, in the monomer charge, a suitable crosslinker in amount of about 0.1 to 4%, preferably 0.2 to 1% by weight based on the combined weight of the carboxylic monomer and the comonomer(s). The crosslinker is selected from polymerizable monomers which contain a polymerizable vinyl group and at least one other polymerizable group. Polymerization of the carboxyl-containing monomers is usually carried out in a catalyzed, free radical polymerization process, usually in inert diluents, as is known in the art.

Other polycarboxylic acid polymer compositions which can be employed include, for example, crosslinked copolymers of acrylates, (meth)acrylic acid, maleic anhydride, and various combinations thereof. Commercial polymers are available from Rheox Inc., Highstown, N.J. (such as Rheolate® 5000 polymer), 3 V Sigma, Bergamo, Italy (such as Stabelyn® 30 polymer, which is an acrylic acid/vinyl ester copolymer, or Polygel® and Synthalen® polymers, which are crosslinked acrylic acid polymers and copolymers), Noveon® (such as Carbopol® 674 (lightly crosslinked polyacrylate polymer), Carbopol® 676 (highly crosslinked polyacrylate polymer), Carbopol® EP-1 thickener, which is a acrylic emulsion thickener), or Rohm and Haas (such as Acrysol® ICS-1 and Aculyn® 22 thickeners, which are hydrophobically modified alkali-soluble acrylic polymer emulsions and Aculyn® 44 thickener, which is a hydrophobically modified nonionic polyol). Preferred are the Carbopol® and Pemulen® polymers, generally. The choice of the specific polymer to be employed will depend upon the desired rheology of the composition, and the identity of other compositional ingredients.

Clay thickeners comprise, for example, colloid-forming clays, for example, such as smectite and/or attapulgite types. The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas may vary with the processing to which the clay has been subjected.

Commercially available clays include, for example, montmorillonite, bentonite, volchonskoite, nontronite, beidellite, hectorite, saponite, sauconite and vermiculite. The clays herein are available under various trade names such as Gelwhite GP, Gelwhite H, Mineral Colloid BP, and Laponite from Southern Clay Products, Inc., Texas; and Van Gel O from R. T. Vanderbilt. Gelwhite H-NF has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Gelwhite L-NF has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Gelwhite GP has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Mineral Colloid BP has a typical chemical analysis of $SiO_2$ 62.9%; $Al_2O_3$ 17.1%; MgO 2.4%; $Fe_2O_3$ 4.8%; CaO 0.7%; $Na_2O$ 2.1%; $K_2O$ 0.2%; $TiO_2$ 0.1%.

A second type of expandable clay material useful in the instant invention is classified geologically as attapulgite (polygorskite). Attapulgites are magnesium-rich clays having principles of superposition of tetrahedral and octahedral unit cell elements different from the smectites. A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150.degree. C.; 10.13% $H_2O$ removed at higher temperatures. Like the smectites, aftapulgite clays are commercially available. The preferred clay thickeners comprise the inorganic, colloid forming clays of smectite and/or attapulgite types.

The thickener constituent can be present in the cleaning composition in any suitable amount. As will be understood, the amount of thickener used will depend upon the desired viscosity and the other ingredients included in the composition. Preferably, the composition has a viscosity of from about 0 to about 15,000 cPs, preferably a viscosity of from about 50 to about 1200 cPs, and especially from about 80 to about 500 cPs. The viscosity of the compositions may be measured according to known techniques, for example using a Brookfield Type III viscometer, #2 spindle, 20 rpm at room temperature (20° C.). While it is clearly understood that the amount of a particular thickener constituent needed to produce a desired viscosity may vary depending upon the nature of the particular thickener constituent and the other constituents present in the composition, advantageously the thickener constituent is present in an amount of from 0.01-5 wt. %

It is to be specifically noted that one or more surfactants may be used as a thickener constituent and/or the thickener system. When such are utilized, such surfactants may thus simultaneously provide both the detersive surfactant and the thickener system and in such an instance a separate detersive surfactant is not required to be present. Exemplary surfactants which may provide both cleaning and thickening include amine oxides, sarcosinates as well as alkoxylated fatty amine compounds.

Suitable organic solvents which may be included in the cleaning composition include those which are at least partially water-miscible such as alcohols, water-miscible ethers (e.g. diethylene glycol diethylether, diethylene glycol dimethylether, propylent glycol dimethylether), water-miscible glycol ethers (e.g. propylene glycol monomethylether, propylene glycol mono ethylether, propylene glycol monopropylether, propylene glycol monobutylether, ethylene glycol monobutylether, dipropylene glycol monomethylether, dipropylene glycol monopropyl ether, dipropylene glycol monobutyl ether, diethyleneglycol monobutylether), lower esters of monoalkylethers of ethyleneglycol or propylene glycol (e.g. propylene glycol monomethyl ether acetate) all commercially available such as from Union Carbide (Danbury, Conn.), Dow Chemical Co. (Midland, Mich.) or Hoescht (Germany). Further organic solvents suitable for use in the cleaning composition are hydrocarbon solvents, especially branched chain hydrocarbon solvents. The hydrocarbon solvents may be linear or branched, saturated or unsaturated, hydrocarbons having from about 8 to about 18 carbon atoms, preferably comprise from about 12 to about 16 carbon atoms. Saturated hydrocarbons are preferred, as are branched hydrocarbons. Nonlimiting examples of some suitable linear hydrocarbons include decane, dodecane, decene, tridecene, and combinations thereof. Exemplary branched hydrocarbons include isoparaffins, examples of which include commercially available isoparaffins from ExxonMobil Corp. such as ISOPAR H and ISOPAR K ($C_{11}$-$C_{12}$ isoparaffins), and ISOPAR L ($C_{11}$-$C_{13}$ isoparaffins). Preferred branched hydrocarbons are isohexadecane, isododecane, 2,5-dimethyl decane, isotetradecane, and combinations thereof. Mixtures of several organic solvents can also be used.

Optionally, a bleach constituent or an oxidizing constituent may be present. The bleach constituent includes those selected from alkali metal and alkaline earth metal salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo- and dichloro dimethylhydantoin, chlorobromodimethyl hydantoin, N-chlorosulfamide(haloamide) and chloramine(haloamine). Particularly preferred for use is sodium hypochlorite having the chemical formula NaOCl. The oxidizing constituent is preferably a peroxyhydrate or other agent which releases hydrogen peroxide in aqueous solution. Such materials are per se, known to the art. Such peroxyhydrates are to be understood as to encompass hydrogen peroxide as well as any material or compound which in an aqueous composition yields hydrogen peroxide. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. Desirably, when present, the oxidizing constituent is hydrogen peroxide.

When an oxidizing agent is present, especially where such is hydrogen peroxide, it may be advantageous to include a peroxide stabilizer which may be useful in improving the high temperature stability of the peroxide constituent, and of the compositions as well. Such a peroxide stabilizer may be one or more known art peroxide stabilizers including, inter alia, one or more organic phosphonates, stannates, pyrophosphates. Further known art peroxide stabilizers include 1-hydroxy-1,1-ethylidene diphosphonate commercially available as Dequest® 2010 as well as further similar phosphonate compounds.

The compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Examples of such fragrances include digeranyl succinate, dineryl succinate, geranyl neryl succinate, geranyl phenylacetate, neryl phenylacetate, geranyl laurate, neryl laurate, di(b-citronellyl)maleate, dinonadol maleate, diphenoxyanol maleate, di(3,7-dimethyl-1-octanyl)succinate, di(cyclohexylethyl)maleate, diflralyl succinate, di(phenylethyl)adipate, 7-acetyl-1,2,3,4,5,6,7,8-octahydro-1,1,6,7-tetramethyl naphthalene, ionone methyl, ionone gamma methyl, methyl cedrylone, methyl dihydrojasmonate, methyl 1,6,10-trimethyl-2,5,9-cyclododecatrien-1-yl ketone, 7-acetyl-1,1,3,4,4,6-hexamethyl tetralin, 4-acetyl-6-tertbutyl-1-, 1-dimethyl indane, para-hydroxy-phenyl-butanone, benzophenone, methyl beta-naphthyl ketone, 6-acetyl-1,1,2,3,3,5hexamethyl indane, 5-acetyl-3-isopropyl-1,1,2,6-tetramethyl indane, 1-dodecanal, 4-(4-hydroxy-4-methylpentyl)-3-cyclohexene-1-carboxaldehyde, 7-hydroxy-3,7-dimethyl ocatanal, 10-undecen-1-al, isohexenyl cyclohexyl carboxaldehyde, formyl tricyclodecane, condensation products of hydroxycitronellal and methyl anthranilate, condensation products of hydroxycitronellal and indol, condensation products of phenyl acetaldehyde and indol, 2-methyl-3-(para-tert-butylphenyl)-propionaldehyde, ethyl vanillin, heliotropin, hexyl cinnamic aldehyde, amyl cinnamic aldehyde, 2-methyl-2-(para-iso-propylphenyl)propionaldehyde, coumarin, decalactone gamma, cyclopentadecanolide, 16-hydroxy-9-hexadecenoic acid lactone, 1,3,4,6,7,8-hexahydro-4,6,6,7,8,8-hexamethylcyclopenta-gamma-2-b-enzopyrane, beta-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-bute-n-1-ol, caryophyllene alcohol, tricyclodecenyl propionate, tricyclodecenyl acetate, benzyl salicylate, cedryl acetate, para-(tert-butyl)cyclohexyl acetate, essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin, and lavender, phenyl ethyl alcohol, terpineol, linalool, linalyl acetate, geraniol, nerol, 2-(1,1-dimethylethyl)cyclohexanol acetate, benzyl acetate, orange terpenes, eugenol, diethylphthalate, and combinations thereof. In the present invention, the precise composition of the fragrance is of no particular consequence so long as it may be effectively included as a constituent of the compositions, and have a pleasing fragrance.

Fragrance compositions as received from a supplier may be provided as an aqueous or organically solvated composition, and may include as a hydrotrope or emulsifier a surface-active agent, typically a surfactant, in minor amount, generally not in excess of about 1.5 wt. % Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

The composition of the invention may include one or more pH adjusting agents, or compounds which provide a degree of alkalinity to the compositions. Particularly preferred pH adjusting agents include ammonium hydroxide, sodium hydroxide and tetrasodium ethylenediamine tetraacetic acid ($Na._4EDTA$). When included such pH adjusting agents are typically present in amounts not in excess of about 3 wt. %

The use of one or more pH buffering compositions so as to maintain the pH of the cleaning composition may also be added. While the composition of the invention generally does not require a pH buffering composition, the use of such a pH buffering composition may provide the benefit of hard water ion sequestration. Examples of such useful pH buffer compounds and/or pH buffering systems or compositions are alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, citrates, and their alkali metal salts. Such buffers keep the pH ranges of the compositions of the present invention within acceptable limits. Others, not particularly elucidated here may also be used.

Exemplary salts which may be included in the compositions include alkali metal and/or alkaline earth metal salts, e.g. those based on borates, bromides, fluorides, phosphates, carbonates, bicarbonates, citrates, chlorides, sulfates, acetates, and lactates. The inclusion of one or more such salts may provide electrolytes which may alter the viscosity of the compositions in which they are present, particularly wherein an acrylate based thickener constituent is used.

The compositions of the invention preferably include a film forming constituent in an effective amount. The use of film forming constituent is believed to provide for a reduction in limescale deposition on the treated hard surfaces, as it is believed that the long term buildup of limescale may be resisted or retarded on hard surfaces, viz., lavatory surfaces and lavatory appliances due to the presence of the film-forming constituent thereon. While it is preferred that the film forming constituent deposit a generally continuous film on a hard surface, it is to be understood that while the film forming constituent need be present in the present cleaning composition it is not required that any layer or film formed therefrom which is formed on the surface of a lavatory appliance, e.g., toilet bowl, be necessarily uniform either in thickness or be a continuous film providing uninterrupted surface coverage although such would be preferred. Rather it is contemplated that film forming materials useful in the present invention need not form a continuous or uniform coating, as it is only required that the film forming materials provide some extent of a surface coating to a hard surface upon which it is applied. It is to be understood that the potential for forming the film layer from a film forming composition is influenced by several factors, inter alia, the nature of the hard surface being treated, the geometry and configuration of the hard surface being treated, the fluid dynamics of the delivery and application of the liquid composition of the invention onto the hard surface, as well as the quality of the water present in the lavatory appliance.

The cleaning composition of the invention can contain any suitable film forming constituent. Suitable film-forming constituents are discussed in detail in U.S. Pat. No. 7,745,384, the disclosure of which is hereby incorporated by reference in its entirety.

The film-forming polymer may be present in any amount which is found effective in forming a film on a hard surface being treated. It will be understood that this amount will vary widely, and is in part dependent upon the molecular weight of the film forming polymer utilized in a formulation, but desirably at least about 0.001 wt. % should be present. More preferably the film forming polymer comprises from 0.001 wt. % to 10 wt. % of the compositions of which it forms a part.

Preservatives which do not include a disinfectant component may also be added in minor amounts in the formulations according to the invention. Compositions known in the art may be used. Examples of such preservatives compounds include those which are presently commercially available under the trademarks Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservatives are generally added in only minor amounts, i.e., amounts of about 0.5% by weight of the total composition, more generally an amount of about 0.1% by weight and less, and preferably present in amounts of about 0.05% by weight and less. Typically such preservative constituents are not necessary in the cleaning composition due to their acidic pH.

The cleaning composition of the invention can be desirably provided as a ready to use product in a manually operated spray-dispensing container or in a deformable "squeeze bottle" type dispenser. With regard to the former, such are known to the art and typically comprise a flask or bottle suited for containing a quantity of the cleaning composition which may be dispensed via a manually operated spray pump, while the latter is also known to the art and typically comprises a deformable bottle, typically formed of a synthetic polymer such a polyolefin (e.g., polyethylene, polypropylene, etc.) or a polyalkylene terephthalate from which the cleaning composition is expelled, typically via a nozzle, by a user compressing part of the deformable bottle. The latter provides a low cost delivery system and is particularly preferred.

In yet a further embodiment, the cleaning composition of the invention may be formulated so that it may be useful in conjunction with an "aerosol" type product wherein it is discharged from a pressurized aerosol container. If the cleaning composition is useful in an aerosol type product, it is preferred that corrosion resistant aerosol containers, such as coated or lined aerosol containers be used. Such are preferred as they are known to be resistant to the effects of acidic formulations. Known art propellants, such as liquid propellants as well as propellants of the non-liquid form, i.e., pressurized gases, including carbon dioxide, air, nitrogen, hydrocarbons as well as others may be used.

Whereas the present invention is intended to be used in the liquid forms described, nothing in this specification shall be understood as to limit the use of the cleaning composition according to the invention with a further amount of water to form a cleaning solution therefrom. In such a proposed diluted cleaning solution, the greater the proportion of water added to form said cleaning solution, the greater may be the reduction of the rate and/or efficacy of the thus formed cleaning solution in the cleaning of a hard surface, as well as a reduction in disinfectant efficacy. Accordingly, longer residence times upon the stain to affect their loosening and/or the usage of greater amounts may be necessitated. Conversely, nothing in the specification shall be also understood to limit the forming of a "super-concentrated" cleaning composition based upon the composition described above. Such a super-concentrated composition is essentially the same as the compositions described above except in that they include a lesser amount of water.

While the cleaning compositions are most beneficial for use in undiluted form, viz., their form as described above, they may also be diluted to form a cleaning composition therefrom. Such cleaning compositions may be easily prepared by diluting measured amounts of the compositions in further amounts of water by the consumer or other end user in certain weight ratios of composition to water, and optionally, agitating the same to ensure even distribution of the composition in the water. The aqueous compositions according to the invention may be used without further dilution, but may also be used with a further aqueous dilution, i.e., in composition to water concentrations of about 1:0 to extremely dilute dilutions such as about 1:10,000, but preferably would be used in a weight or volume ratio proportion of about 1:10 to about 1:100. Generally better results and faster removal are to be expected at lower relative dilutions of the composition and the water.

The compositions according to the invention are easily produced by any of a number of known art techniques. For example, a part of the water can be supplied to a suitable mixing vessel further provided with a stirrer or agitator, and while stirring, the remaining constituents can be added to the mixing vessel, including any final amount of water needed to provide the desired formulation for the cleaning composition.

In a second embodiment, the invention provides a method for cleaning a surface using the cleaning composition described above. The method generally comprises the steps of providing a cleaning composition and applying the cleaning composition to at least a portion of a surface to be cleaned. After application to the surface, the pH of the cleaning composition is raised, either by the interaction of the components of the cleaning composition with the surface and/or contaminants on the surface (e.g., a reaction between an acid in the cleaning composition and dirt or grime on the surface) or by dilution with another medium (e.g., water) during the cleaning. The method can further comprise the step of rinsing the cleaning composition from the surface.

As noted above, the method entails the step of providing a cleaning composition according to the invention, such as any of those described in the preceding parts of this specification. As described above, the cleaning composition comprises a colorant that exhibits a first color state at a relatively low pH (e.g., the relatively low starting pH of the cleaning composition). Thus, the cleaning composition will also exhibit a first color state that is imparted to the composition by the presence of the colorant. Further, once the pH of the cleaning composition is raised, the colorant will exhibit a second color state that is visually distinct from the first color state. This, in turn, causes the cleaning composition to exhibit a second color state. This change in color state can, as described above, serve as a visual indicator to those using the cleaning composition.

As noted above, the method comprises the step of raising the pH of the cleaning composition so that the cleaning composition exhibits a second color state. This raising of the pH can be brought about either passively or by user action, and this step of the method recited in the claims is intended to encompass both passive and active raising of the pH. For example, the pH can be raised by an interaction between a component in the cleaning composition (e.g., an acid) and the surface to which it has been applied and/or contaminants (e.g., dirt or grime) on this surface. In particular, the pH of the cleaning composition can be raised as an acid in the composition dissolves (and undergoes an acid base reaction with) limescale deposits on the target surface. The pH can also be raised as the cleaning composition is mixed with another medium (e.g., water) during the cleaning process.

The cleaning composition and method described above can be used to clean any suitable surface. Preferably, the surface to be cleaned is a hard, non-porous surface, such as glazed tile, porcelain, enameled surfaces (e.g., enameled metals), solid surface materials (e.g., composites of polymers and minerals, such as alumina trihydrate), metal, or glass. The cleaning composition and method preferably can be used to clean the surface of bath fixtures, such as vanity tops, sinks, toilets, bidets, and urinals. In a preferred embodiment, the cleaning composition and method can be used to clean a surface of a toilet (e.g., the surface of the toilet's bowl).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A cleaning composition comprising at least one surfactant and at least one colorant, wherein the cleaning composition exhibits a pH of about 3 or less, and wherein the at least one colorant is selected from the group consisting of colorants conforming to a structure of Formula (II), (III), or (IV) below at a pH of about 7

(II)

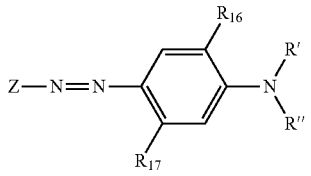

wherein R' is selected from the group consisting of hydrogen and $R_2$; R" is selected from the group consisting of hydrogen and $R_3$; $R_{16}$ is selected from the group consisting of hydrogen, hydroxyl, $C_1$-$C_4$ alkyl, $C_1$-$C_4$ alkoxy, and —$SO_3^-D$; $R_{17}$ is selected from the group consisting of hydrogen, hydroxyl, $C_1$-$C_4$ alkyl, and $C_1$-$C_4$ alkoxy; and Z is selected from the group consisting of substituents conforming to a structure of Formula (IIA), (IIB), (IIC), or (IID)

(IIA)

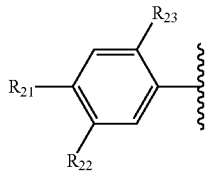

wherein $R_{21}$ is selected from the group consisting of hydrogen, —$CO_2^-M$, and $SO_3^-D$; and $R_{22}$ and $R_{23}$ are independently selected from the group consisting of hydrogen and —$SO_3^-M$;

(IIB)

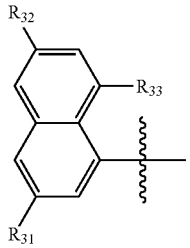

wherein $R_{31}$ and $R_{32}$ are independently selected from the group consisting of hydrogen and —$SO_3^-M$; and $R_{33}$ is selected from the group consisting of hydrogen and hydroxyl;

(IIC)

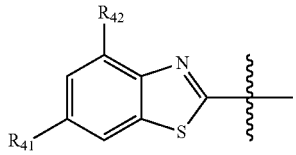

wherein $R_{41}$ and $R_{42}$ are independently selected from the group consisting of hydrogen, $C_1$-$C_4$ alkyl, alkoxy, —$SO_3^-M$, —$CO_2^-M$, and —$NO_2$;

(IID)

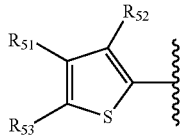

wherein $R_{51}$ is selected from the group consisting of hydrogen and $C_1$-$C_4$ alkyl; $R_{52}$ and $R_{53}$ are each independently selected from the group consisting of hydrogen, alkyl, alkyl ester, cyano, aryl, amide, nitro, alkanoyl, aryloyl, a sulfonic acid group, and halogen; each M is independently selected from the group consisting of metal cations; and wherein each D is independently selected from the group consisting of M and a quaternary ammonium group conforming to the structure of Formula (X)

(X)

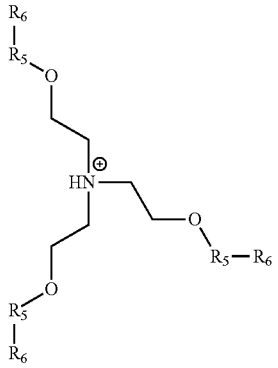

provided if R' and R" are both hydrogen then Z is a substituent conforming to the structure of Formula (IIA) and at least one of $R_{16}$ and $R_{21}$ is $—SO_3^-D$ in which D is a quaternary ammonium group conforming to the structure of Formula (X);

(III)

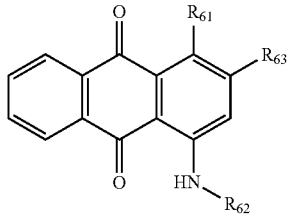

wherein $R_{61}$ is selected from the group consisting of hydrogen, hydroxyl, and $—NHR_{64}$; $R_{64}$ is selected from the group consisting of hydrogen, $R_2$, and E; $R_{62}$ is selected from the group consisting of aryl groups, $R_3$, and G; $R_{63}$ is selected from the group consisting of hydrogen and $—O—R_5—R_6$, provided that $R_{63}$ is $—O—R_5—R_6$ when $R_{61}$ is hydrogen or $—NHR_{64}$, $R_{64}$ is hydrogen, and $R_{62}$ is an aryl group; E is a group conforming to the structure of Formula (XI)

(XI)

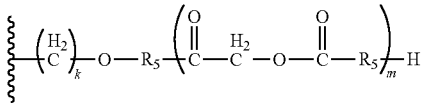

wherein k is an integer from 1 to 10; m is an integer from 0 to 10; G is a group conforming to the structure of Formula (XII)

(XII)

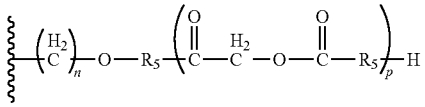

wherein n is an integer from 1 to 10; p is an integer from 0 to 10; and when $R_{61}$ is $—NHR_{64}$, $R_{64}$ is E, and $R_{62}$ is G, the sum of m and p is from 1 to 10;

(IV)

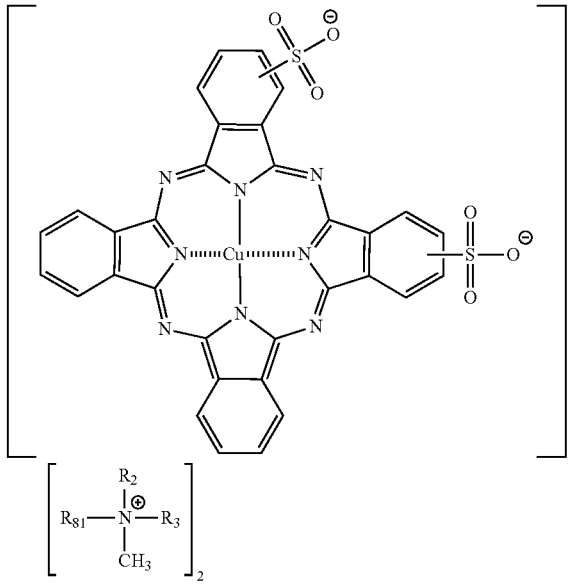

wherein $R_{81}$ is selected from the group consisting of $C_8$-$C_{20}$ alkanoyl groups and $C_8$-$C_{20}$ alkenoyl groups;

wherein $R_2$ is selected from the group consisting of $—R_4—O—R_5—R_6$, $R_3$ is selected from the group consisting of $—R_4—O—R_5—R_6$ and a bond to $R_{15}$ when $R_{15}$ is an alkanediyl group, $R_4$ is selected from the group consisting of alkanediyl groups and arenediyl groups; $R_6$ is selected from the group consisting of hydrogen, alkyl groups, alkanoyl groups, alkenoyl groups, and aryloyl groups; and $R_5$ is a divalent substituent selected from the group consisting of:

(i) divalent substituents comprising two or more divalent repeating units independently selected from repeating units conforming to the structure of Formula (XX)

(XX)

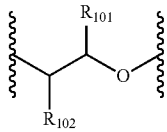

wherein $R_{101}$ and $R_{102}$ are independently selected from the group consisting of hydrogen, alkyl, hydroxyalkyl, aryl, alkoxyalkyl, and aryloxyalkyl;

(ii) divalent substituents conforming to the structure of Formula (XXI)

(XXI)

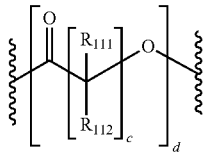

wherein $R_{111}$ and $R_{112}$ are independently selected from the group consisting of hydrogen, hydroxyl, and $C_1$-$C_{10}$ alkyl, c is an integer from 1 to 12, and d is an integer from 1 to 100;

(iii) divalent substituents conforming to the structure of Formula (XXII)

(XXII)

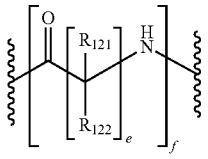

wherein $R_{121}$ and $R_{122}$ are independently selected from the group consisting of hydrogen, hydroxyl, and $C_1$-$C_{10}$ alkyl, e is an integer from 1 to 12, and f is an integer from 1 to 100;

(iv) divalent substituents conforming to the structure of Formula (XXIII)

(XXIII)

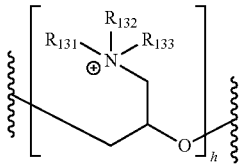

wherein $R_{131}$, $R_{132}$, and $R_{133}$ are independently selected from alkyl and hydroxyalkyl, and h is an integer from 1 to 100; and (v) divalent substituents comprising two or more substituents selected from the group consisting of substituents conforming to a structure of Formula (XX), (XXI), (XXII), or (XXIII).

2. The cleaning composition of claim 1, wherein the colorant conforms to the structure of Formula (V)

(V)

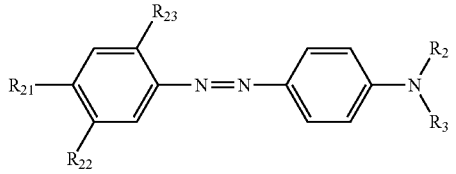

wherein $R_{21}$ is selected from the group consisting of hydrogen and $—CO_2^-Na^+$; $R_{22}$ and $R_{23}$ are independently selected from the group consisting of hydrogen and $—SO_3^-Na^+$.

3. The cleaning composition of claim 1, wherein the colorant conforms to the structure of Formula (VI)

(VI)

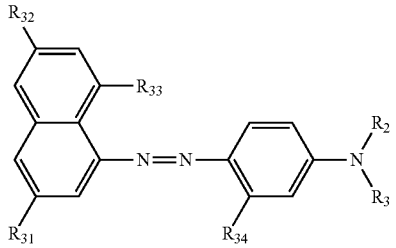

wherein $R_{31}$ and $R_{32}$ are independently selected from the group consisting of hydrogen and $—SO_3^-Na^+$; $R_{33}$ is selected from the group consisting of hydrogen and hydroxyl; $R_{34}$ is selected from the group consisting of hydrogen and $C_1$-$C_4$ alkyl.

4. The cleaning composition of claim 1, wherein the colorant conforms to the structure of Formula (VII)

(VII)

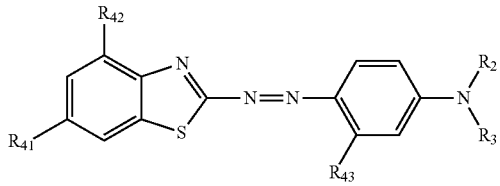

wherein $R_{41}$ and $R_{42}$ are independently selected from the group consisting of hydrogen, $C_1$-$C_4$ alkyl, alkoxy, $—SO_3^-M$, $—CO_2^-M$, and $—NO_2$.

5. The cleaning composition of claim 1, wherein the colorant conforms to the structure of Formula (VIII)

(VIII)

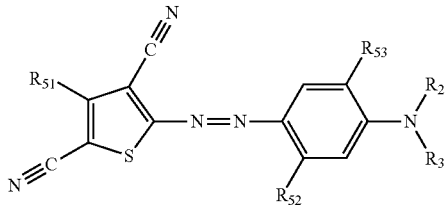

wherein $R_{51}$ is selected from the group consisting of hydrogen and $C_1$-$C_4$ alkyl; $R_{52}$ and $R_{53}$ are independently selected from the group consisting of hydrogen and $C_1$-$C_4$ alkoxy.

6. The cleaning composition of claim 1, wherein the colorant conforms to the structure of Formula (IX)

(IX)

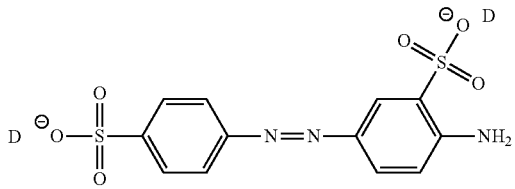

wherein at least one D is a quaternary ammonium group conforming to the structure of Formula (X).

7. The cleaning composition of claim 1, wherein $R_5$ is a divalent substituent comprising two or more divalent repeating units independently selected from repeating units conforming to the structure of Formula (XX).

8. The cleaning composition of claim 1, wherein $R_5$ is a divalent substituent conforming to a structure of Formula (XXA), (XXB), or (XXC)

(XXA)

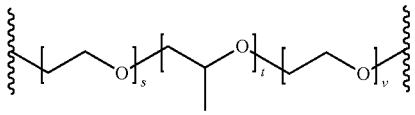

(XXB)

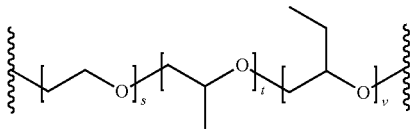

-continued (XXC)

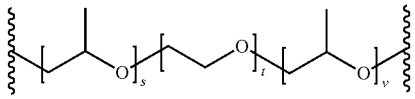

wherein s, t, and v are selected from the group consisting of zero and positive integers; and the sum of s, t, and v is 2 or more.

9. The cleaning composition of claim 1, wherein the colorant is present in the composition in an amount of about 0.01 wt. % to about 1 wt. % based on the total weight of the composition.

10. The cleaning composition of claim 1, wherein the composition further comprises an acid selected from the group consisting of mineral acids, organic acids, and mixtures thereof.

11. The cleaning composition of claim 1, wherein the composition comprises a surfactant selected from the group consisting of alcohol ethoxylates, amine ethoxylates, fatty acid amides, and mixtures thereof.

12. The cleaning composition of claim 1, wherein the surfactant is present in the composition in an amount of about 0.5 wt. % to about 20 wt. %.

* * * * *